US008448276B2

(12) United States Patent
Carroll

(10) Patent No.: US 8,448,276 B2
(45) Date of Patent: May 28, 2013

(54) WAX, SCRAPER AND BUFFER COMBINATION DEVICE FOR TUNING SKIS AND SNOWBOARDS

(75) Inventor: Michael Carroll, Incline Village, NV (US)

(73) Assignee: Michael Carroll, Incline Village, NV (US)

( * ) Notice: Subject to any disclaimer, the term of this patent is extended or adjusted under 35 U.S.C. 154(b) by 612 days.

(21) Appl. No.: 12/544,085

(22) Filed: Aug. 19, 2009

(65) Prior Publication Data

US 2011/0045752 A1 Feb. 24, 2011

(51) Int. Cl.
*A63C 11/00* (2006.01)

(52) U.S. Cl.
USPC ..... 7/158; 7/167; 118/72

(58) Field of Classification Search
USPC ..... 7/158, 165, 167; 118/72
See application file for complete search history.

(56) References Cited

U.S. PATENT DOCUMENTS

| | | | | | |
|---|---|---|---|---|---|
| 2,379,745 | A | * | 7/1945 | Pischel et al. | 118/72 |
| 2,851,712 | A | * | 9/1958 | Howard | 401/19 |
| 3,816,863 | A | * | 6/1974 | Thielemann, Jr. | 7/165 |
| 3,934,287 | A | * | 1/1976 | Howard | 7/158 |
| 3,968,345 | A | * | 7/1976 | Kollmeder | 219/228 |
| 4,054,962 | A | * | 10/1977 | Janke | 15/105 |
| 4,189,874 | A | * | 2/1980 | Labriola | 451/461 |
| 4,204,693 | A | * | 5/1980 | Wicksell et al. | 280/809 |
| 4,215,947 | A | * | 8/1980 | Sparling | 401/125 |
| 4,557,030 | A | * | 12/1985 | Gaston et al. | 29/402.06 |
| 4,738,887 | A | * | 4/1988 | Govertsen | 428/133 |
| 4,999,224 | A | * | 3/1991 | Bocquet et al. | 427/356 |
| 2005/0103807 | A1 | * | 5/2005 | Murphy | 222/226 |
| 2008/0086829 | A1 | * | 4/2008 | Adams | 15/236.01 |

OTHER PUBLICATIONS

Wikipedia, "Ski wax," http://en.wikipedia.org/wiki/Ski_wax Website, available as of at least Aug. 19, 2009.

Swix Sport AS, "SwixSport.com: SwixProduct/Products," http://www.swixsport.com/eway/default.aspx? pid=278 &trg=MainContent_6179&MainContent_6179=6117:0:24,2653 Website, available as of at least Aug. 19, 2009.

Smile Plastics Ltd, "smileplastics," http://www.smile-plastics.co.uk/ Website, available as of at least Aug. 19, 2009.

Zandur, "Zandur Cork Products: Cork Sheet, Stoppers, rolls, toppers, bungs, floats, bulletin boards, handles, wine, crafts, plugs & more!," http://www.zandur.com/ Website, available as of at least Aug. 19, 2009.

Green Wax, "Green Wax—Premium Organic Ski and Snowboard Wax," http://www.greenskiwax.com/ Website, available as of at least Aug. 19, 2009.

* cited by examiner

*Primary Examiner* — Maurina Rachuba

(57) ABSTRACT

A tuning device consisting of a wax piece, a scraper, and a buffer in a portable unit for creating a waxed surface for skis and snowboards. The tuning device may also include a cord or strap for carrying the device and a cap fitting over the wax for keeping other surfaces from coming in direct contact with the wax while carrying and storing the device. The wax cap may also be used to form new wax on the tuning device. The tuning device allows for the application of wax to the base surface of all types of skis and snowboards. The wax is first applied to the base surface of the ski or snowboard, filling in scratches and gouges on the base surface. The excess wax is then scraped off using the scraper. The base surface of the ski or snowboard where the wax was applied is then polished using the buffer.

17 Claims, 12 Drawing Sheets

WAX, SCRAPER AND BUFFER COMBINATION DEVICE FOR TUNING SKIS AND SNOWBOARDS

BRIEF DESCRIPTION OF THE INVENTION

A combination tuning device consisting of wax, a scraper and a buffer all contained within an integrated portable unit for waxing and tuning the bottom surface of skis and snowboards. The combination device may also include a cord for carrying the device, as well as a cap that fits over the wax and keeps other surfaces from coming in direct contact with the wax while carrying and storing the device. The wax cap may also be used as a mold for enabling the wax on the combination device to be replenished. The combination device allows for the application of wax to the base surface of all types of skis and snowboards. The wax is first applied to the bottom base surface of the ski or snowboard, filling in scratches and gouges on the base surface. The excess wax is then scraped off using the scraper. The base surface of the ski or snowboard over which the wax was applied is then polished using the buffer.

CROSS-REFERENCES TO RELATED APPLICATIONS

Not applicable.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

A newly waxed bottom or base surface of a ski or snowboard provides for easier turning of the ski or snowboard, better control, and a faster surface to ride on. When in use, the friction between the base surface of the ski or snowboard and the snow generates a thin layer of water on the base surface. Too much water results in a wet drag, and too little water results in a dry drag. A properly waxed base surface will optimize the balance between too much and not enough water on the base surface, thereby improving the performance of the ski or snowboard. Waxing a ski or snowboard also serves to repair scratches and gouges that have been formed in the base surface while in use due to contact with branches, rocks and ice.

Wax comes in various formulas, including paste, liquid, and hard wax. There are two primary types of wax: glide wax (further explained below) and grip wax. Grip wax allows a Nordic/cross-country skier to propel forward by gripping the snow when the skier puts pressure on the kick zone of the ski, further releasing the snow as the skier takes the stride and the pressure on the kick zone is decreased. Hence, grip wax is only used for Nordic skis, while glide wax can be applied to Nordic skis, alpine skis, and snowboards.

Wax is typically applied as a hot wax or a cold wax. Some users, as well as sports and ski/snowboard shops, will apply a hot wax to the base surface to create a smooth surface by filling in the scratches and gouges. A hot wax surface of glide wax is applied by first heating the appropriate wax until melted, then dripping the melted wax onto the base of a ski or snowboard. The wax is then typically ironed using a heated iron. After the base has cooled, the excess wax is scraped off. Finally, the base surface is buffed to allow for a fast surface which minimizes friction.

Applying a hot wax surface, however, requires extensive experience in waxing and appropriate equipment and space, making it difficult and impractical for the average user to do it themselves on a regular basis. Having a hot wax surface applied by a shop can be expensive and inconvenient because the skis or snowboards have to be left and picked up and are unavailable for use during that time.

The type of glide wax used to wax skis/snowboards also depends on the snow temperature, crystal structure, and humidity of the snow. For example, one type of wax will yield better performance in man-made snow, while another type of wax will perform better in cold and dry conditions. A user might have a certain type of glide wax applied as a hot wax some time prior to skiing, but find that the hot wax applied is the wrong type of wax for the ski conditions when the user arrives at the ski slope. Hence, the user might need to apply a cold wax at the ski slope to improve the base surface's performance. Regardless of the wax applied, waxed bases are easier to turn, more durable, and faster than unwaxed bases, which is why the process of applying wax to a ski or snowboard is referred to as tuning, as it improves the performance of the ski or snowboard, like tuning an instrument before use improves its performance.

There are cold wax products in the market that provide waxing solutions that can be easily applied to skis and snowboards, but which do not provide as high quality of a waxed base as traditional hot waxing. Nevertheless, these products can improve base surface performance and extend the period between applications of hot wax. For example, a user can buy a block of wax and carry it with them while skiing. When they want to apply the wax, they remove the wax from their clothing or a pouch and rub it on the base surface. To smooth the newly waxed surface, the user would then need to scrape off excess wax with something. Typically, a user would carry a separate scraper with them for this purpose. Once the excess wax was removed, the surface should be smoothed using another device, such as a piece of cork, which the user would need to carry with them as well.

Obviously, carrying one or more different types of wax, a scraper and cork is not something every user will want to do. Further, if the wax is stored on the user near their heated body, the wax may begin to melt and be absorbed by the material surrounding the wax, which is not desirable. Even without the application of heat, the wax can simply rub off on surrounding materials, thereby ruining or fouling that material. Finally, the separate pieces needed to properly wax the base surface increase the likelihood that the user will forget one, such as the scraper or the smoother, or might lose one or more while skiing or digging around in their pockets looking for something else.

To partly address this problem, SWIX SPORT developed a waxing kit that includes F4 fluoro wax and a cork. The kit consists of a hexagon plastic container that contains and holds the wax, to keep it from ruining any surrounding material, with a thin circular layer of cork adhered to the bottom of the container for spreading and polishing the applied wax. Some problems with the SWIX SPORT product are that it does not include a scraper and the container is too large to make the product portable. It can be used before using the skis or snowboard, but the bulky container is not convenient for carrying around. Hence, the user would be required to remove the wax, carry a separate scraper, and not have access to the wax when using the product in-between ski runs or at a ski lodge.

Cork or cork-like materials are used for smoothing the wax on the base surface of the ski or snowboard. Cork is used in place of a wax iron to wax a surface because rubbing the cork against the base surface, after wax has been separately applied, generates sufficient heat to help melt the wax into the base surface. Natural cork is preferably used for hydrocarbon-based wax and can generate more heat than synthetic cork. Synthetic cork is preferably used for fluorocarbon-based waxes or additives. Waxing corks can be large in size, or attached to a wood block, in order for the cork to be easily handled when polishing. However, this tends to make corks bulky. Felt pads can also be used as a buffer.

Other portable wax containers include an applicator, allowing for the wax to be easily applied to the base surface of the ski or snowboard without a waxing iron. Wax kits consisting of a small portable pack containing wax, a cork or polishing cloth, and sometimes a base cleaner, but not a scraper, are also popular. While the packs are portable, they tend to be bulky and cannot be easily carried inside a pocket. These packs simply provide users with the convenience of not having to buy each item separately, but do not solve the problem of carrying and using them while skiing or snowboarding.

Wax scrapers tend to be made of plastic or metal, such as steel. The scrapers can range in size, from a few inches for portable scrapers, to bigger scrapers to be used on surfaces such as snowboards. The majority of scrapers tend to be flat, rectangular, and at least 15 cm in length, in order to reduce the effort on scraping the entire base of the ski or snowboard. This allows users to grip one edge of the rectangle, and use it as leverage to apply pressure using the opposite edge of the scraper. Some scrapers are also shaped in a triangular form, increasing the life span of the scraper since it allows users to use a different side of the scraper triangle in case one of the edges goes dull. However, triangular scrapers can be awkward to handle at times when scraping off excess wax on the base surface of the ski or snowboard.

Steel and plastic are the most used materials for scrapers. Steel or other metals have a longer lifespan, since they do not go dull as fast as the plastic scrapers, and they can also be sharpened. The disadvantage of metal scrapers is that the sharper edges and hardness of steel or metal scrapers can damage the base surface if too much force is applied or if used improperly. Another problem is that even if the scraper is small in size, it is an additional tool that must be carried along with wax and buffer if the user wants to apply some wax to the skis or snowboard while on the slopes.

Having a waxed base surface is important for the best ski or snowboard performance. Portable solutions have been presented, but they are not integrated and are not convenient for carrying, especially while on the slopes.

DETAILED DESCRIPTION OF THE INVENTION

The present invention consists of a combination tuning device that includes wax, a scraper, and a buffer in an integrated portable unit. The tuning device may include a cord or strap for carrying the tuning device around the user's neck or tied to an outer portion of their clothing or equipment, and a wax cap for keeping other surfaces from coming in direct contact with the wax while carrying and storing. The wax cap may, in turn, be used as a form or mold for applying new wax to the tuning device. The tuning device allows for the application of wax to the base surface of all types of skis and snowboards. The wax is first applied to the base surface of the ski or snowboard, filling in scratches and gouges on the base surface, if any. The excess wax is then scraped off using the scraper. The sections of the base surface of the ski or snowboard where the wax was applied are then polished using the buffer.

The tuning device provides a convenient wax applicator that can be used at home, in the car, or even on the hill while skiing or snowboarding. The tuning device can be used all season without hot waxing if applied regularly every four to six hours of riding time. If used in combination with hot waxing, it can extend the time between hot waxing applications.

The tuning device may be designed using various dimensions, permitting for the tuning device to be used for all types of skis, including alpine, freeride, telemark, cross-country, and freestyle; and all types of snowboards, including racing and alpine, freeride, freestyle, park/jib, all-mountain, and split.

Figure 1:
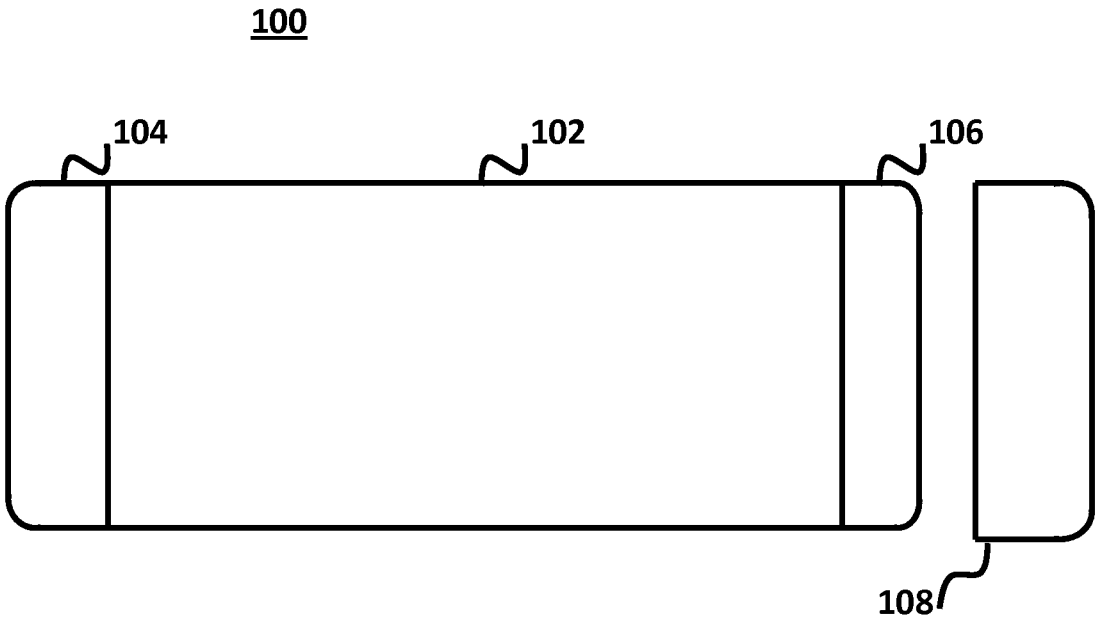
FIG. 1 illustrates a top view of the preferred embodiment of the present invention.

FIG. 1 illustrates a top view of the preferred embodiment of the present invention. The tuning device 100 consists of a scraper 102, cork 104, and wax 106. The scraper 102 is preferably made of recycled plastic, but other materials may also be used. Plastic is the preferred material because it results in sharp but malleable edges that can effectively scrape the wax without damaging the base surface of the skis and snowboards by making scratches or gauging the base surface while scraping the wax. The preferred plastic for the scraper body 102 is made out of dappled, recycled plastic sheets, manufactured by Smile Plastics Ltd. The recycled plastic sheets could be made from a variety of colored industrial food containers mixed with white or black plastic from underground irrigation pipes, such as polyvinyl chloride or PVC pipes. This particular recycled material provides for a hard material sufficient to scrap off excess wax without damaging the base surface.

The scraper 102 is rectangular in shape. The four long edges of the scraper 102 are used to scrape off the wax applied to a ski or snowboard. In the preferred embodiment of the present invention, the length of the scraper 102 would be 80 mm, with a height of 13 mm, and a width of 44 mm. The 13 mm height is preferred because it creates four separate scrapping edges that can be used for tuning, instead of one, two or three sides. This height also insures that the scraper will be rigid enough to withstand pressure applied by the user during use. While the preferred embodiment is presented using these dimensions, different values for the length, height, and width may be used, as long as the tuning device includes the scraper 102, buffer 104, and wax 106. The scraper, buffer, and wax may also be arranged in various shapes, as will be discussed herein.

The length of the scraper 102 will vary depending on the type of skis and snowboards for which it will be used. Cross-country skis are long and narrow, with a typical length of 2 meters and 50 mm in width. Alpine skis can range in width, typically ranging from 60 mm to 90 mm in width. Snowboards can range in width between 24 cm (240 mm) to 27 cm (270 mm). In an embodiment of the present invention, the length of the scraper 102 would be approximately 50 mm or wider, allowing for the scraper length to cover the width of the base of a cross-country ski. In another embodiment of the present invention, the length of the scraper 102 would be approximately 70 mm or wider to cover the width of the base of a typical alpine ski. In yet another embodiment of the present invention, the length of the scraper 102 would be 26 cm or wider, allowing for the scraper length to cover the width of the base of a typical snowboard. For using the tuning device with snowboards, a scraper 102 with a smaller length may also be used in order for the tuning device to be conveniently carried and stored by the user. Alternatively, the tuning device can be custom made with the dimensions requested by a user.

In the preferred embodiment, the wax 106 and the buffer 104 are attached to the right and left ends of the body of the scraper 102, however the relative placement of the wax 106 and the buffer 104 is not important. In another embodiment of the present invention, the tuning device 100 includes a cap 108 that fits tightly over the wax 106. The cap 108 serves the purpose of keeping the wax 106 from coming in contact with other surfaces, especially clothing if the tuning device is carried in a garment pocket by the user. The cap 108 also keeps the wax from spilling in case the wax 106 reaches its melting point, and could further be used for forming new wax on the tuning device, as will be further discussed herein.

Figure 7:
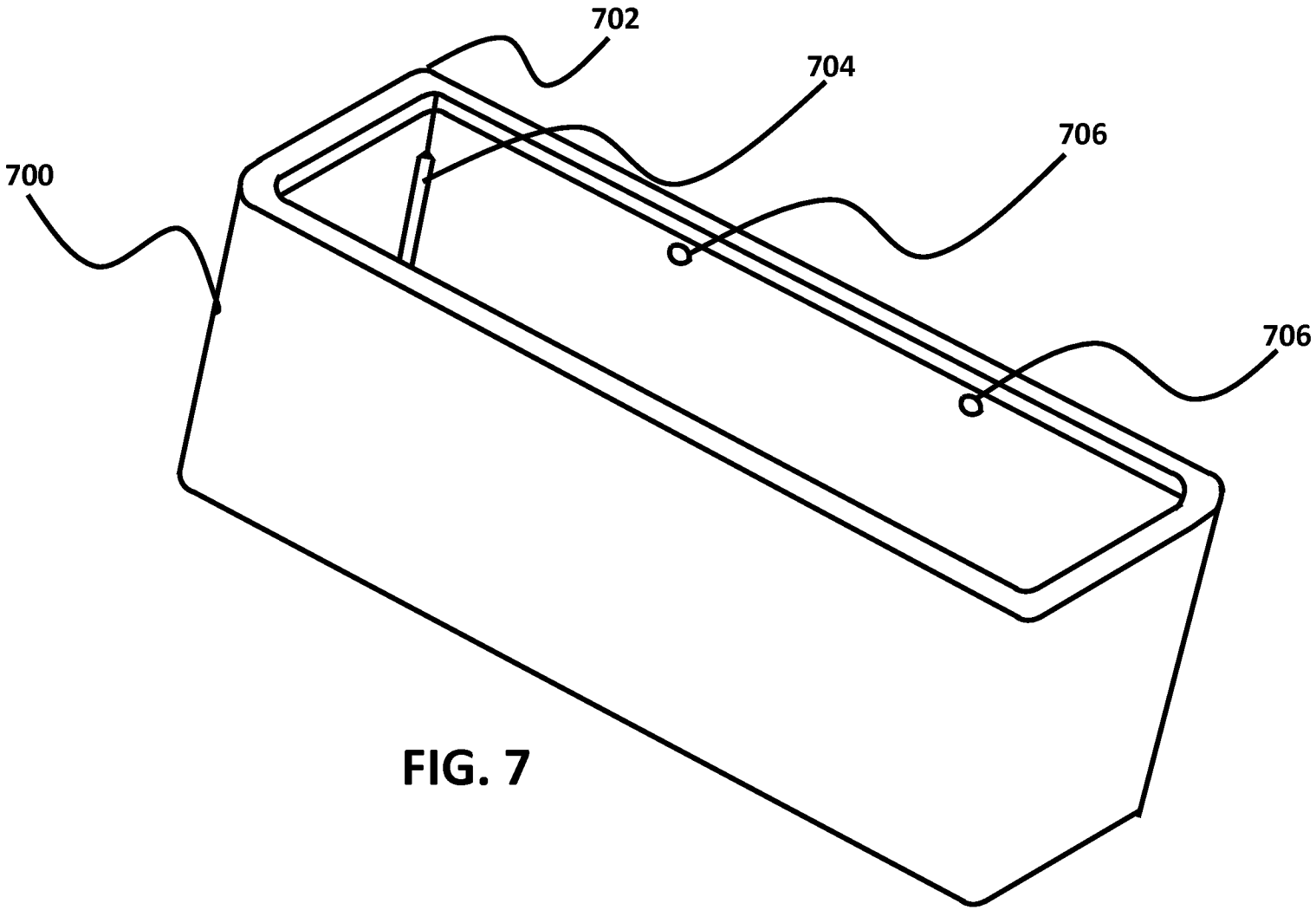
FIG. 7 illustrates an embodiment of a simple cap for the tuning device.

In the preferred embodiment of the present invention, the cap 108 would be an opaque plastic, fitting tightly over the wax end 106. FIG. 7 shows the preferred embodiment of the cap 108, labeled as 700 in FIG. 7. The cap 700 would be rectangular, with slightly rounded corners 702. The cap 700 would include a triangular wedge 704 along each of the inside corners of the cap 700. These triangular wedges 704 would help secure the cap by providing friction against the wax. Two rounded protrusions 706 on each side of the inside of cap 700 would also help fasten the cap on the tuning device. The rounded protrusions help fasten the cap 700 on the tuning device by either increased pressure between the wax 106 and the cap 700, or between the scraper 102 and the cap 700, depending on where the rounded protrusions are located.

Figure 8:
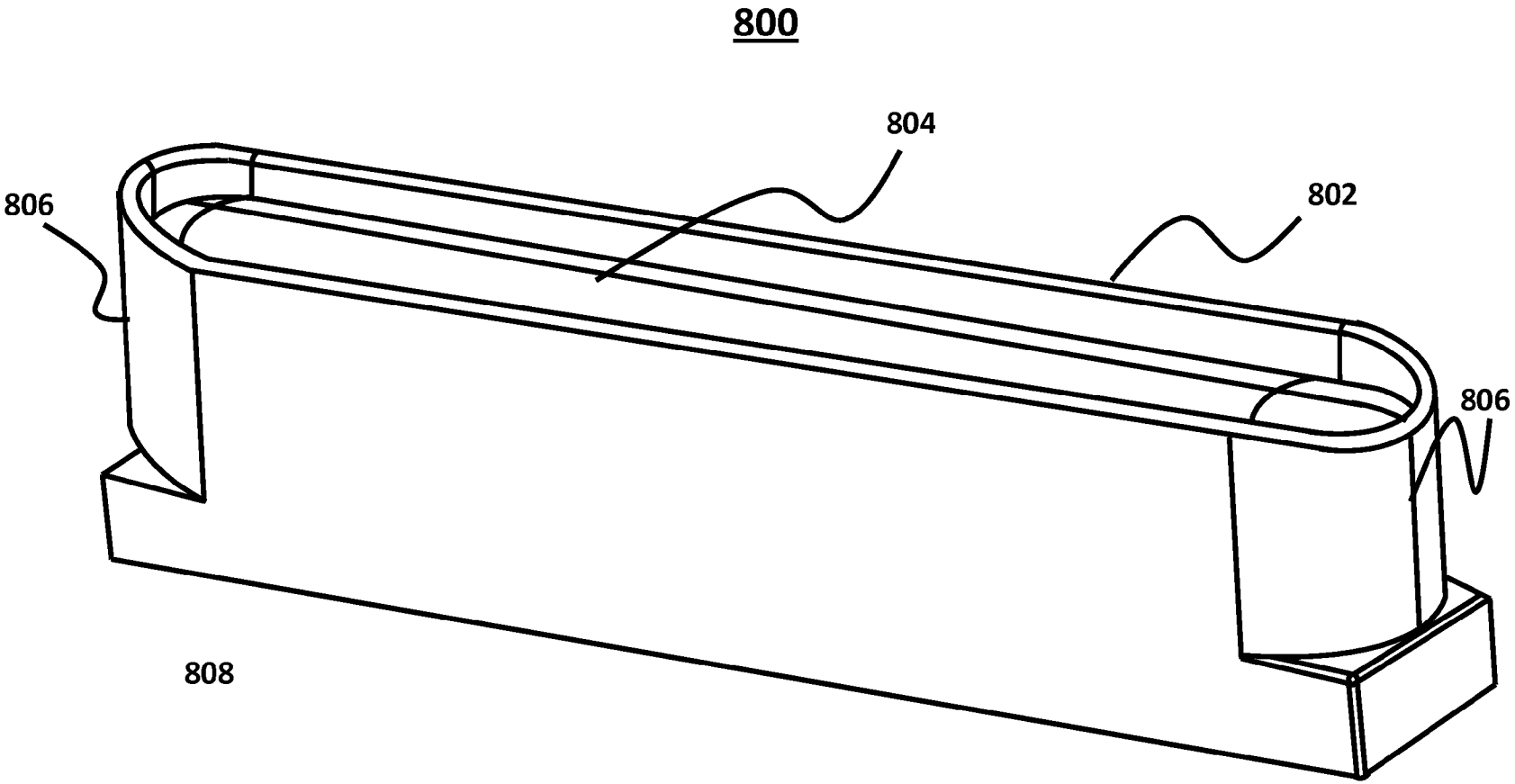
FIG. 8 illustrates an embodiment of a reforming wax cap for the tuning device.

FIG. 8 shows an alternative embodiment of the cap 108, labeled as 800 in FIG. 8. The cap 800 is used for reforming wax on the tuning device. The cap 800 would have rounded ends 806 that match the shape of the wax 106. The end of the cap 800 would have an outer lip 802 that would allow for the tuning device to stand on end, with the cap in place, when forming new wax. The top of the cap 804 would be slightly rounded, to allow for the wax to be formed with a rounded end for easier application. The top of the cap 804 would be below the level of the outer lip 802. The cap 800 could also include protrusions or wedges as those described in FIG. 7, in order for the cap to fit securely over the wax 106.

The cap 108 would also include a designated mark on the inside of the cap 108, to ensure the proper amount of wax is applied to the end of the scraper body 102 when forming new wax. When the cap 108 is used as a form or mold for adding new wax, it would be removed from the tuning device and set on a flat surface with its opening point upward. The user would then melt a small amount of appropriate wax in a small, clean, tin can over a heating surface, such as a hot plate, or stove top. The tin can would be bent on one side in order to form a spout on the can. Once the wax was melted, the wax would be poured on the cap 108 up to a designated mark on inside of the cap 108. The tuning device would then be securely snapped or locked onto the cap, with the tuning device standing on the cap end. The tuning device could then be placed in a refrigerator or outside on a cool day to allow the wax to cool and form in place. This process would allow a user to form new wax on the tuning device versus purchasing a new tuning device each time the wax ran low.

Figure 2:
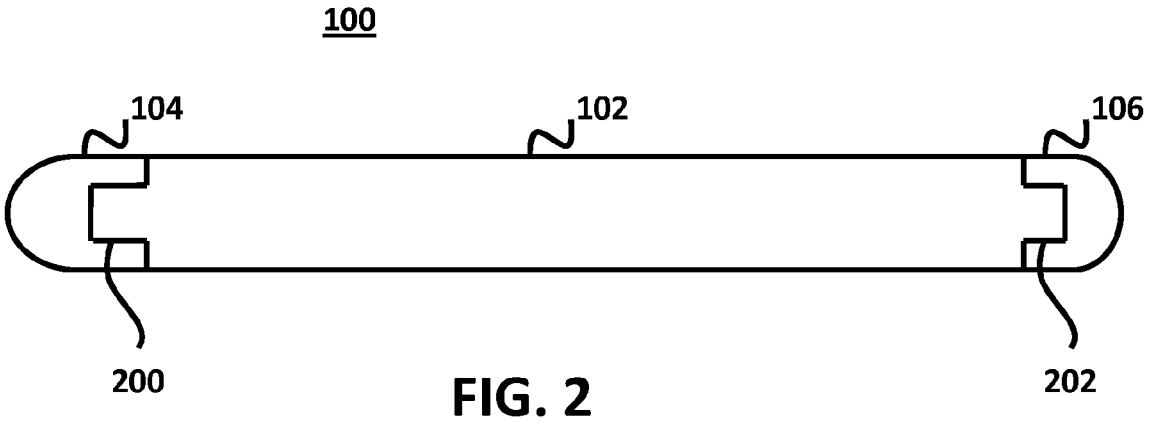
FIG. 2 illustrates a side view of the preferred embodiment of the present invention.

FIG. 2 illustrates a side view of the preferred embodiment of the present invention. The plastic body of the scraper 102 has a protrusion 200 that extends into the area of the buffer 104, to which the buffer 104 is attached, and a protrusion 202 that extends into the area of the wax 106, to which the wax is attached. Each of the protrusions 200 and 202 provide a better contact surface for the buffer 104 and the wax 106. In the preferred embodiment of the present invention, the protrusions 200 and 202 extend 5 mm from the main body of the scraper 102 into the buffer 104 and wax 106, respectively.

The buffer 104 is glued to the body of the scraper 102 using contact cement or a similar type of adhesive. The buffer 104 can be made from natural cork, synthetic cork, or felt padding. The end of the buffer 104 will be rounded and polished, as illustrated in FIG. 2. The end of the buffer 104 is used to buff and polish the base surface of the ski or snowboard after the wax 106 has been applied and scrapped using the scraper 102.

The wax 106 is melted, and then allowed to form around the protrusion 202, either using the cap 108, as previously discussed herein, or by using some other mold during the manufacturing process. Replacement wax pieces with a self-adhered interior surface could also be made and sold separately. A user would scrape off the remaining wax when the wax on the tuning device is ready to be replaced so as to create a clean adhesive surface, and then place the replacement wax piece on the end. Alternatively, the wax could be attached to a removable part (not shown) of the scraper 102 that could be easily removed from and connected to the scraper so that the wax 106 could be easily replaced without scraping off old wax or adhering the new wax.

In the preferred embodiment of the present invention, performance wax, manufactured by GREEN WAX, is used to form the wax 106. GREEN WAX performance wax performs well within a broad range of temperatures, and is all-natural, biodegradable, and environmentally safe for mountains since it does not contain perfluorocarbons or petroleum. Waxes containing perflurocarbons or petroleum leave chemical residuals on the mountain. While a non-toxic and biodegradable wax is the preferred type of wax 106 for the tuning device, any other type of wax used for skis and snowboards may be used instead. The wax 106, similar to the buffer 104, will be rounded for easy application to the base surface of the ski and snowboard. The wax 106 may be a glide wax or a grip wax depending on the intended use of the tuning device.

The sizes of the buffer 104 and the wax 106 may be the same, or may be different sizes. The buffer 104 might be slightly larger than the wax 106, or vice-versa. Similarly, the protrusions 200 and 202 for the buffer 104 and the wax 106 do not have to be the same size. The presence of the protrusions 200 and 202 helps the buffer 104 and the wax 106 to attach better to the body of the scraper 102. Although the protrusions are shown in FIG. 2 as rectangular in shape, they could be formed of other shapes, such as having slightly larger or bulbous ends so as to cause the buffer 104 or wax 106 to be harder to accidently be removed from the tuning device. In the preferred embodiment of the present invention, the width and height of the buffer 104 and wax 106 would be the same as the scraper 102 and cause the length of the tuning device to extend 12 mm or more beyond the length of the scraper 102 on either end.

Figure 3:
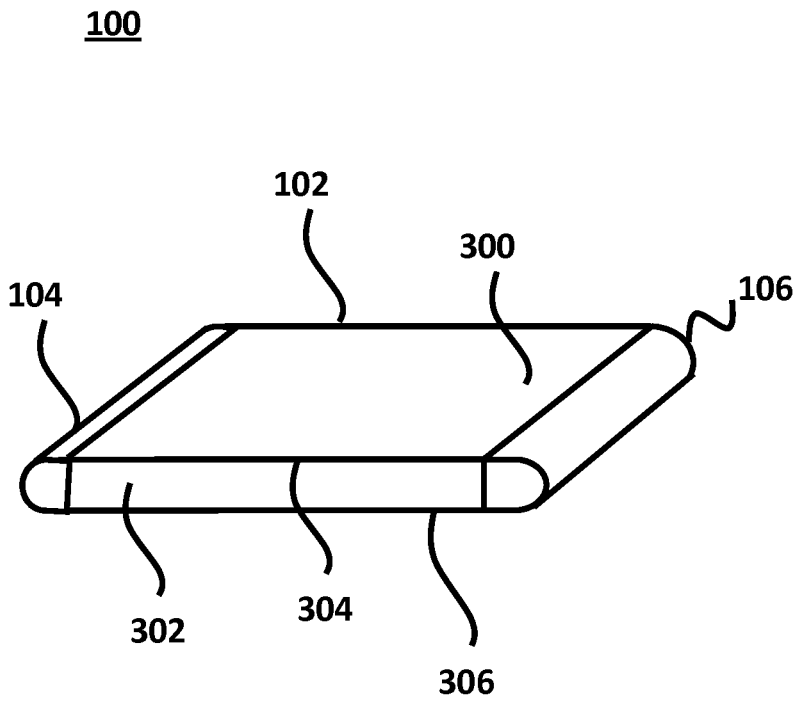
FIG. 3 illustrates a perspective view of the preferred embodiment of the present invention.

FIG. 3 illustrates a perspective view of the preferred embodiment of the tuning device 100. The top surface 300 of the scraper 102 meets with the side surface 302 of the scraper 102 at the edge 304. The side surface 302 of the scraper 102 also meets with the bottom surface (not visible) of the scraper 102 along the edge 306. Similarly there are two edges on the side where the top surface of the scraper 102 and the bottom surface of the scraper 102 meet with the second side surface, which is not visible, for a total of four edges. The edges of the scraper are used to perform the scraping function on the base surface of skis and snowboards. The edges of the scraper must be sharp enough to be able to scrape off the excess wax on the base surface of the ski or snowboard. However, the edges must also be flexible enough to come in contact with the base surface of the ski or snowboard without inflicting damage in case the user applies excessive force. In an embodiment of the present invention, two out of the four edges of the scraper 102 are lined with metal. The metal would be preferably made of steel, but an alternative metal could also be used. The other two edges could then be left without the metal lining. This would give the user the benefit of both a sharp and hard edge, and also the sturdy plastic edge that would not damage the base surface.

In an embodiment of the present invention, the tuning device may also include a cord or strap for carrying the tuning device 100. The cord or strap preferably would be attached to the top surface 300 or bottom surface (not visible) of the scraper body 102, as long as it does not impede the scraping motion. Alternatively, the cord could be attached to one of the side surfaces, such as side surface 302. The material for the carrying cord could be neoprene rubber, leather, nylon, etc. In one embodiment, a hole would be drilled through the scraper body 102, with the hole running across the width of the scraper 102, or running diagonally from the top surface 300 or bottom surface (not visible) of the scraper body 102 to one of the side surfaces of the scraper body 102. Alternatively, a small metal ring or clip, or an alternative closed loop point for attachment could be glued or otherwise attached to the scraper body 102. The cord or strap could then be threaded through the hole, ring, or alternative closed loop. If a clip was attached to the top surface 300, the entire tuning device could be clipped to a belt or loop on the user's clothing or gear. A carabineer could also be attached to the clip or loop on one end and a separate clip or loop on the user's clothing or gear.

Figure 4A:
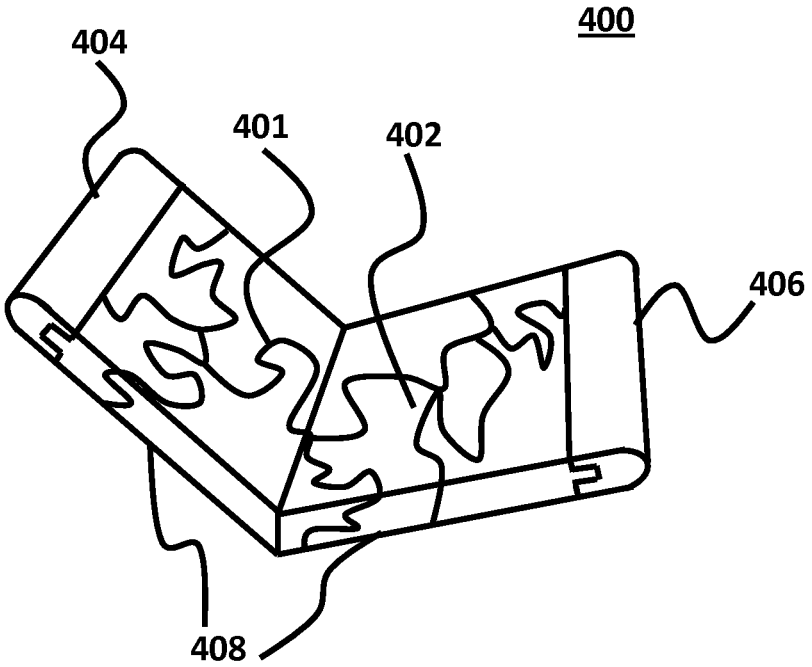
FIG. 4A illustrates a V-shaped embodiment of the present invention.

The tuning device may also be assembled in various other shapes, such as those shown in FIGS. 4 to 6. What is important is for the tuning device to include the wax, the buffer, and the scraper in a single integrated device. FIG. 4A shows an alternate embodiment of the tuning device 400 of the present invention with a pattern 401 formed therein from the recycled plastic material. The tuning device 400 could be substantially V-shaped, with the body of the V-shape 402 consisting of the scraper, and the buffer 404 and wax 406 attached to the ends of the V-shape. The tuning device 400 combines all aspects of the present invention, with a user being able to wax a surface with the wax stick 406, scrape it using the V-shaped body of the scraper 402, and polish the surface using the buffer 404. The buffer 404 may be a natural or synthetic cork, or a felt pad. As discussed herein, the preferred material for the scraper 402 would be recycled plastic, but metal may also be used for the scraper body 402. The recycled plastic sheets used to form the scraper may be formed from different types of plastic, with different colors, giving the scraper a multi-colored dappled pattern. The edges of the side faces 408 of the scraper 402 would be used for the scraping of excess wax. The edges of the side faces 408 may also be lined with metal to increase the longevity of the scraper 402.

Figure 4B:
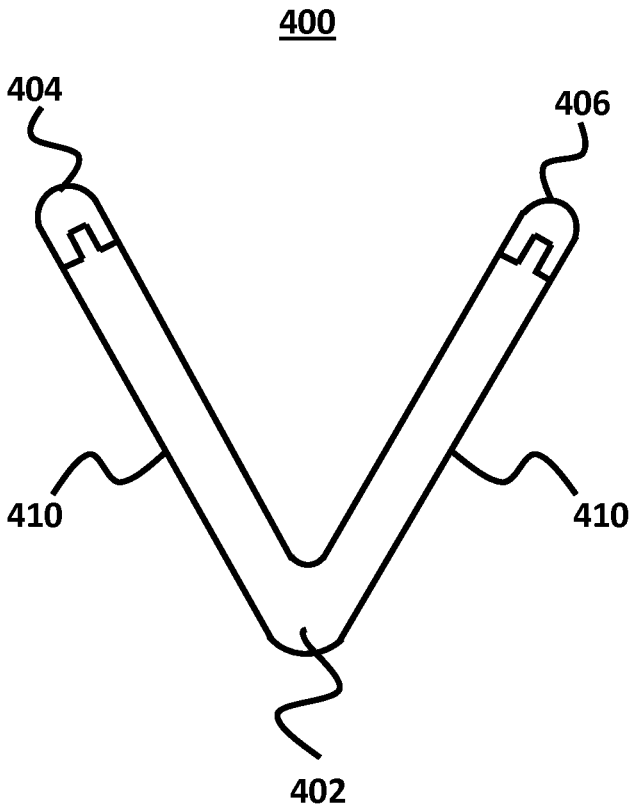
FIG. 4B illustrates a side view of the V-shaped embodiment of the present invention.

FIG. 4B illustrates a side view of the V-shaped embodiment of the tuning device 400. The buffer 404 and the wax 406 at attached to the ends of the V-shape. The ends of the V-shape could also protrude from the scraper 402, allowing for a better contact surface with the buffer 404 and the wax 406. The flat outer edges 410 of the V-shape would be used for scraping.

Figure 5A:
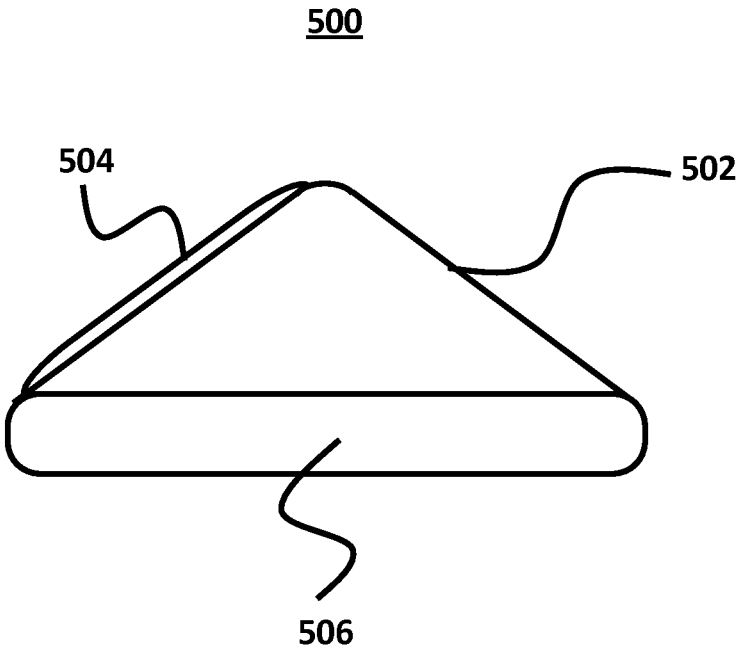
FIG. 5A illustrates a triangular embodiment of the present invention.
Figure 5B:
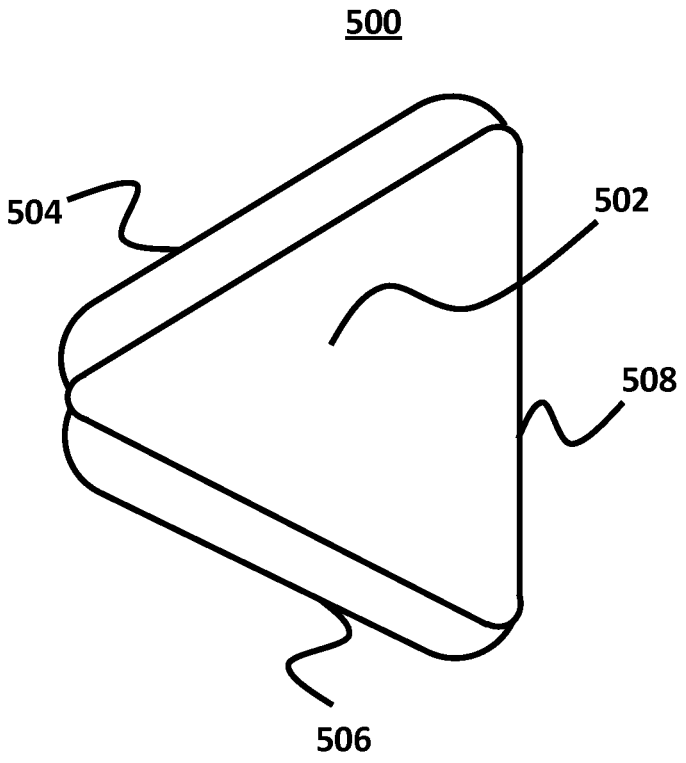
FIG. 5B illustrates a top view of the triangular embodiment of the present invention.

FIG. 5A illustrates a triangular shape embodiment of the tuning device 500. The triangular body of the tuning device 500 consists of the scraper 502. One of the edges is covered with the buffer 504, while the other edge is covered with the wax stick 506. The empty edge of the scraper body 502 can then be used for scraping. The tuning device would be a triangular solid, hence providing two edges for scraping. FIG. 5B illustrates a top view of the triangular shape embodiment of the tuning device 500. The buffer 504 covers the entire length of an edge of the triangular scraper body 502. The wax 506 covers the entire length of a second edge of the triangular body 502. The third edge 508 of the triangular scraper body 502 would be used for the scraping function.

Figure 6A:
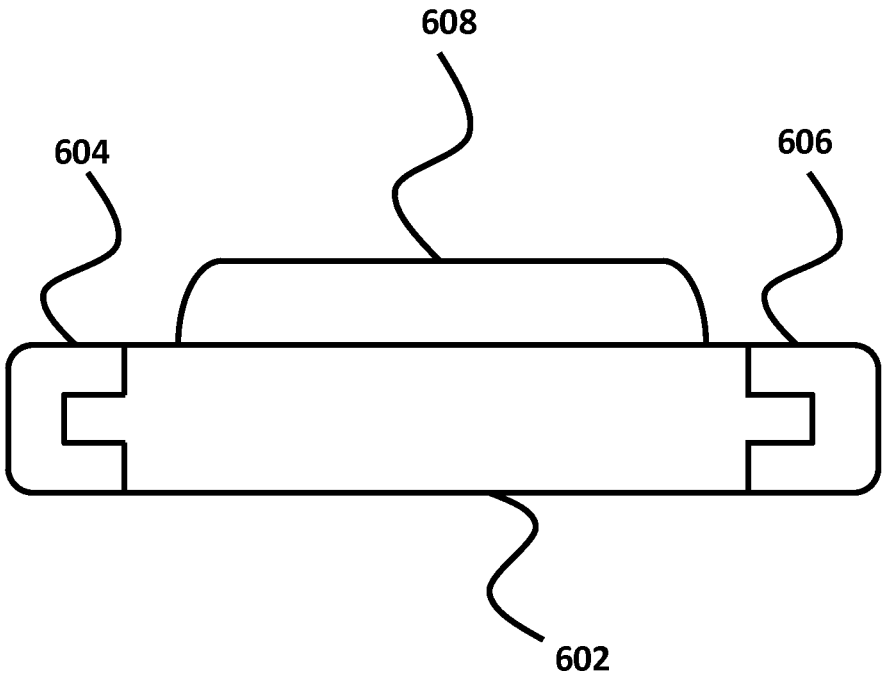
FIG. 6A illustrates a side view of an alternative embodiment of the present invention.
Figure 6B:
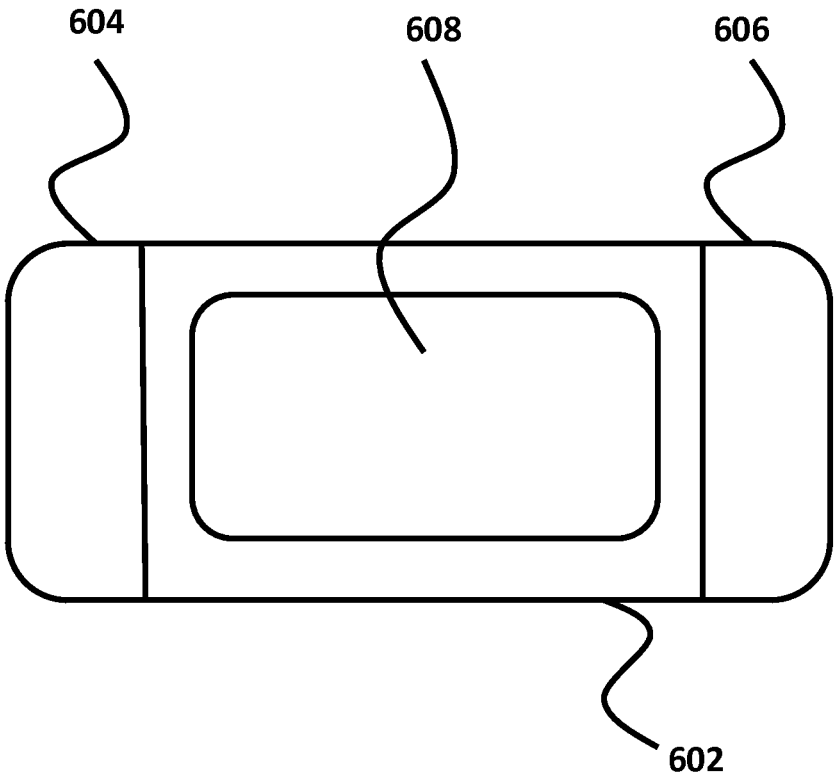
FIG. 6B illustrates a top view of the alternative embodiment of the present invention.
Figure 6C:
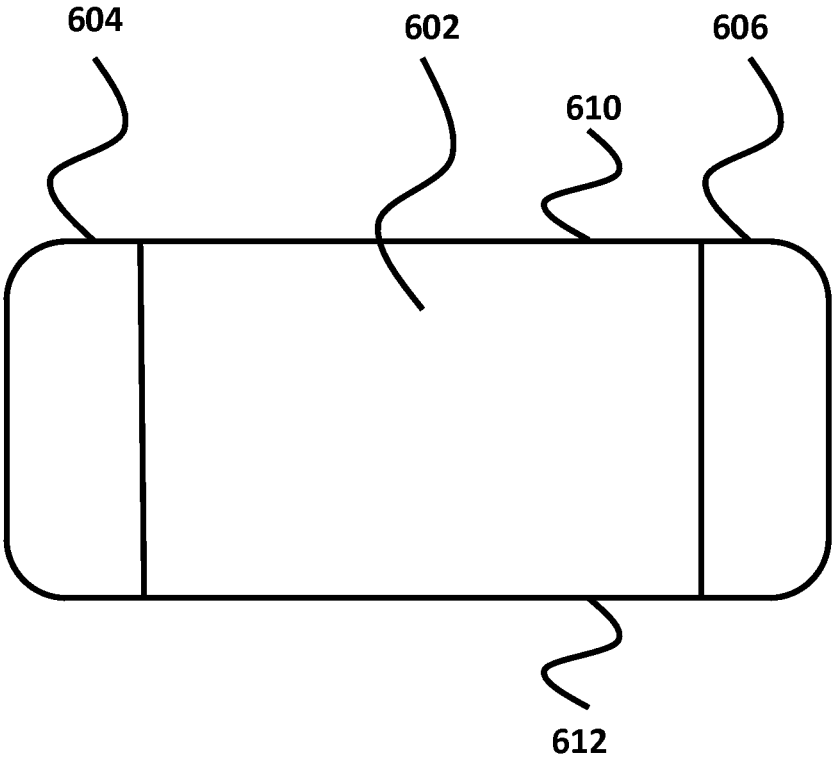
FIG. 6C illustrates a bottom view of the alternative embodiment of the present invention.

FIG. 6A illustrates a side view of another possible shape of the tuning device. In FIG. 6 the tuning device 600 is similar to the preferred embodiment of the present invention 100, with the difference being that one of the faces, either top or bottom, of the scraper body 602 has a buffer block attached to it 608. In one embodiment, the block 604 attached to one end of the scraper body 602 could contain one type of wax, while the second block 606 could contain a different type of wax. For example, the block 604 could contain wax for wet conditions in slushy snow, ranging in temperature from 10 degrees C. to 0 degrees C., while the block 606 could contain wax for cold conditions ranging from −2 degrees C. to −30 degrees C. The edges of the scraper body could be used for scraping the excess wax off the base surface. The buffer 608 could be made of cork, or it could be a felt pad. FIG. 6B illustrates a top view of the tuning device 600. The buffer 608 would cover a large portion of the top face of the scraper body 602, providing a large contact surface for polishing. FIG. 6C illustrates a bottom view of the tuning device 600. The edges 610 and 612 of the scraper body 602 would be used for the scraping function.

While the present invention has been illustrated and described herein in terms of a preferred embodiment and several alternatives associated with various features, it is to be understood that the various components and features of the tuning of elements described herein and the combination itself can have a multitude of different arrangements, uses and applications. Accordingly, the invention should not be limited to just the particular descriptions and various drawing figures contained in the specification that merely illustrate one or more preferred embodiments and applications of the principles of the invention.

What is claimed is:

1. A tuning device for creating a smooth waxed surface on a ski or snowboard, comprising:

a scraper;

a wax piece adhered to the scraper;

a buffer adhered to the scraper;

further comprising a cap fitting over the wax piece, the cap comprising one or more protrusions on an inside surface of the cap, the protrusions contacting the wax piece and the scraper when the cap is fit over the wax piece.

2. The tuning device as recited in claim 1, wherein the scraper has a first edge, a second edge, a third edge and a fourth edge for scraping wax from the ski or snowboard, and has a first distance between the first edge and the second edge and a second distance between the third edge and the fourth edge, the first distance and the second distance being sufficient to prevent the scraper from bending excessively during use.

3. The tuning device as recited in claim 2, wherein a total of two edges out of the first edge, the second edge, the third edge and the fourth edge include a metal strip adhered to the scraper.

4. The tuning device as recited in claim 1, wherein the scraper is substantially V-shaped with a first wing separated from a second wing by a middle portion, a first end on the first wing opposite the middle portion, and a second end on the second wing opposite the middle portion, wherein the wax piece is adhered to the first end, and the buffer is adhered to the second end.

5. The tuning device as recited in claim 1, wherein the scraper is a triangular shape having a first flat side, a second flat side, a first edge side, a second edge side and a third edge side, wherein the wax piece is adhered to the first edge side of the scraper, and wherein the buffer is adhered to the second edge side of the scraper.

6. The tuning device as recited in claim 1, wherein the scraper is a triangular shape having a first flat side, a second flat side, a first edge side, a second edge side and a third edge side, wherein the wax piece is adhered to the first edge side of the scraper, and wherein the buffer is adhered to the first flat side of the scraper.

7. The tuning device as recited in claim 1, wherein the scraper is a triangular shape having a first flat side, a second flat side, a first edge side, a second edge side and a third edge side, wherein the wax piece is adhered to the first flat side of the scraper, and wherein the buffer is adhered to the first edge side of the scraper.

8. The tuning device as recited in claim 1, wherein the scraper is a triangular shape having a first flat side, a second flat side, a first edge side, a second edge side and a third edge side, wherein the wax piece is adhered to the first flat side of the scraper, and wherein the buffer is adhered to the second flat side of the scraper.

9. The tuning device as recited in claim 1, wherein the scraper is a rectangular shape having a first end and a second end opposite the first end with a flat face between the first end and the second end, wherein the wax piece includes a first type of wax piece and a second type of wax piece, wherein the first type of wax piece is adhered to the first end, wherein the second type of wax piece is adhered to the second end, and wherein the buffer is adhered to the flat face.

10. The tuning device as recited in claim 1, wherein the buffer is made of one from a group consisting of a natural cork, a synthetic cork and a felt pad.

11. The tuning device as recited in claim 1, wherein the scraper is made of a plastic material.

12. The tuning device as recited in claim 11, wherein the plastic material is a recycled material.

13. The tuning device as recited in claim 12, wherein the scraper includes a first edge made of metal and a second edge made of metal.

14. The tuning device as recited in claim 1 wherein the cap forms a mold for holding melted wax to form a new wax piece on the tuning device when the wax piece has been used up.

15. The tuning device as recited in claim 1, wherein the wax piece is formed of an environmentally safe wax material.

16. The tuning device as recited in claim 1, further comprising a chord or strap attached to the scraper.

17. The tuning device as recited in claim 1, further comprising a clip adhered to the scraper.

* * * * *